US006749542B2

(12) United States Patent
Wu et al.

(10) Patent No.: US 6,749,542 B2
(45) Date of Patent: Jun. 15, 2004

(54) TREADMILL

(76) Inventors: Peter Wu, No.1, Lane 233, sec.2, Charng Long Rd., Taiping (TW), 411; Leao Wang, No.1, Lane 233, sec.2, Charng Long Rd., Taiping (TW), 411

( * ) Notice: Subject to any disclaimer, the term of this patent is extended or adjusted under 35 U.S.C. 154(b) by 89 days.

(21) Appl. No.: 10/133,257

(22) Filed: Apr. 29, 2002

(65) Prior Publication Data

US 2004/0033865 A1 Feb. 19, 2004

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 6,328,676 B1 * 12/2001 Alessandri ..... 482/54
6,572,513 B1 * 6/2003 Whan-Tong et al. ..... 482/54
6,652,424 B2 * 11/2003 Dalebout ..... 482/54

* cited by examiner

*Primary Examiner*—Glenn E. Richman
(74) *Attorney, Agent, or Firm*—Kuo-Hsiung Chiu

(57) ABSTRACT

The present invention relates to a treadmill having a base frame with a handrail. The base frame is provided with two rollers at both ends thereof. A support plate is interposed between both rollers. And a walking belt is disposed around the rollers and the support plate. The base frame has a plurality of crossbars in the position of the support plate, and the crossbars is provided with at least one buffer piece in the middle thereof which is in contact with the bottom face of the support plate. A support element has a bottom member on the base frame and a top member fixed on the bottom of the support plate, and both members are pivotably connected, thereby positioning the support plate indirectly on the base frame. Accordingly, the injury of the feet is avoided and the service life of the support plate is prolonged.

2 Claims, 3 Drawing Sheets

TREADMILL

BACKGROUND OF THE INVENTION

1. Fields of the Invention

The present invention relates to a treadmill, and more particularly, to a treadmill which offers buffering effect during the walking exercise while the curved extent of the support plate can be counteracted.

2. Description of the Prior Art

FIG. 1 shows a side view of a conventional treadmill 10 having a handrail 15, a sloping base frame 12 on both ends of which two rollers 16 are mounted. A support plate 14 is disposed on both rollers 16 and is screwed with a plurality of buffer pieces 13 at the side thereof so that the support plate 14 is indirectly fixed on the base frame 12. Thereafter, a walking belt is disposed around both rollers 16 and the support plate 14.

When the operator walks on the treadmill, the feet exert pressure on the walking belt 11 for a cyclic movement. While the support plate 14 is pressed down, the buffer pieces 13 are simultaneously pressed downward. Therefore, the loading of the support plate 14 can be divided; meanwhile, a reactive force for cushioning is created in order to avoid the exercise injury of the feet.

Most of the loading of the support plate 14 is concentrated in the middle thereof so that the middle part thereof is easily crooked and deformed. However, the buffer pieces 13 at the side of the support plate 14 can't effectively reduce or even remove the concentrating stress, thereby deforming or breaking the support plate 14. On the other side, the buffer pieces 13 can be broken, thereby being separated from the support plate 14. Accordingly, the service life of the treadmill 10 is reduced.

SUMMARY OF THE INVENTION

It is a primary object of the present invention to eliminate the above-mentioned drawbacks and to provide a treadmill whose support elements replace the conventional buffer device and are indirectly fixed to the bottom of the base frame, thereby offering buffering effect at the middle place of the support plate.

It's another object of the present invention to provide a treadmill through which the injuries of feet during exercise session are avoided and the service life of the treadmill is prolonged.

It's a further object of the present invention to provide a treadmill through which the concentration of stress is reduced or removed.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
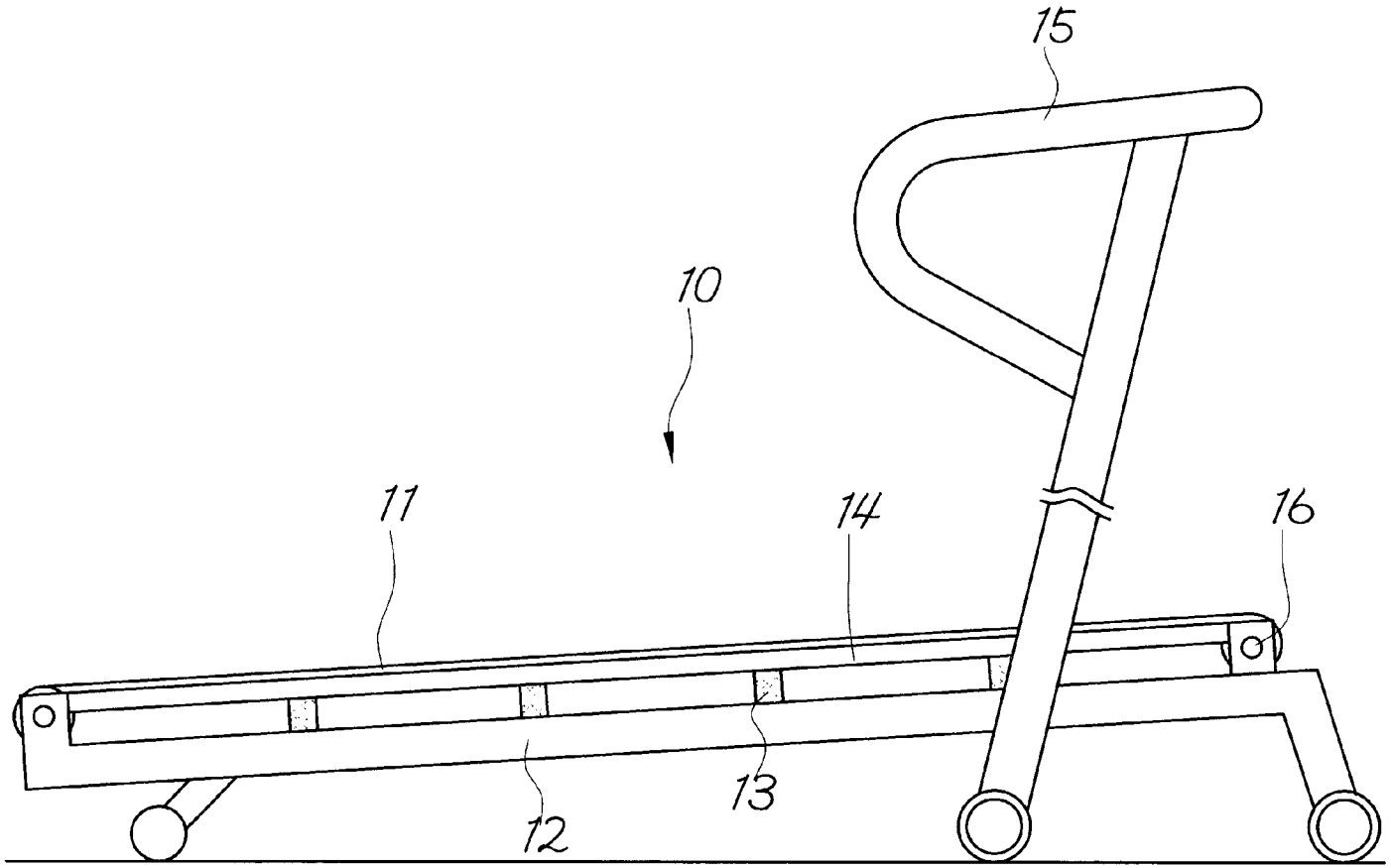
FIG. 1 is a side view of a conventional treadmill.
Figure 2:
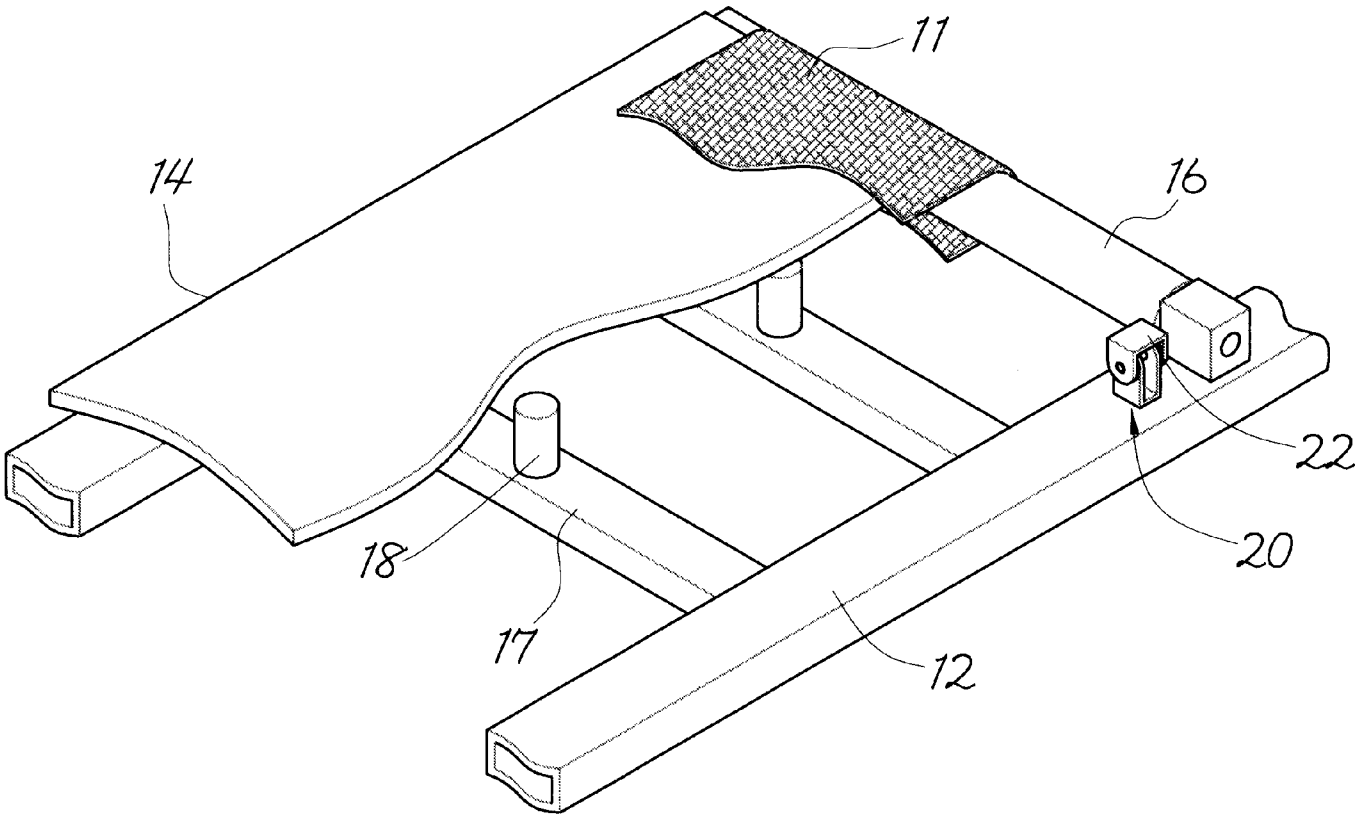
FIG. 2 is a perspective view of a preferred embodiment of the present invention, showing the relationship among the walking belt, the base frame and the support plate.

As shown in FIG. 2, a support plate 14 is mounted between two rollers 16 and situated above a base frame 12. The base frame 12 is provided with strengthening crossbars 17 each of which has at least a buffer piece 18 in the middle thereof. The buffer pieces 18 are in contact with the bottom face of the support plate 14 to support the weight thereof.

A support element 20 comprises a bottom member 21 on the base frame 12 and a top member 22 fixed on the bottom of the support plate 14. Both member 21, 22 are pivotably connected so that the support plate 14 is indirectly positioned on the base frame 12 by means of several support elements 20. Thereafter, a walking belt 11 is arranged around both rollers 16, the support plate 14 and the crossbars 17, thereby forming a treadmill.

Figure 3:
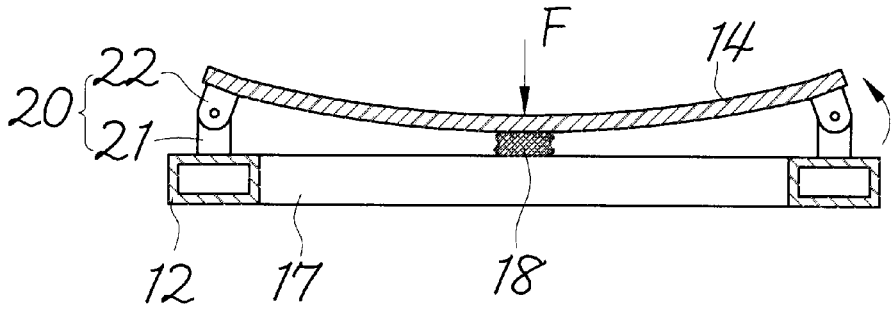
FIG. 3 is a sectional view of FIG. 2 showing the deformed support plate.
Figure 4:
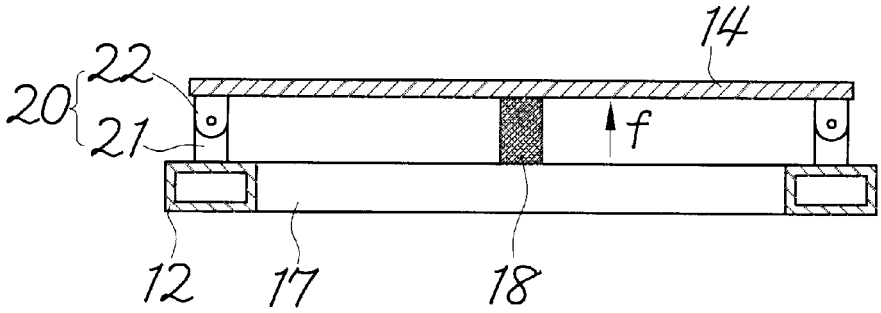
FIG. 4 is a sectional view of FIG. 2 showing that the deformed support plate of FIG. 3 restores itself to original state.

As shown in FIG. 3, when the operator walks on the walking belt of the treadmill, an external force F is transmitted to the support plate 14, thereby deforming the support plate 14 whose center is curved. Thus, the buffer pieces 18 are compressed to absorb the external force to relieve the created reactive force and to reduce the impact upon the feet. Meanwhile, the energy is accumulated for restoring after the external force disappears.

At this time, each top member 22 of the support elements 20 rotates on the pivot between both members 21, 22 in accordance with the curved extent of the support plate 14. Therefore, the external force F shared by each support element 20 can be counteracted or removed.

When the external force disappears, the buffer pieces 18 release the accumulated energy, thereby creating a reactive force f in the restoring direction. Meanwhile, the support plate 14 has its own restoring resilience so that each top member 22 of the support elements 20 restores itself with the movement of the support plate 14. Accordingly, part of reactive force is absorbed or reduced.

In comparison with the conventional one, the treadmill based on the above-mentioned embodiment has following advantages:

1. The support element 20 and the buffer pieces 18 can reduce the effect of the reactive force when the support plate 14 is curved and deformed by external force or restores itself due to the resilience when the external force disappears. Accordingly, the injury of the feet can be avoided and the service life of the support plate 14 can be prolonged.
2. The conventional buffer device is replaced with the support element 20 so that the damage of the support plate 14 caused by the concentration of the stress can be effectively avoided. Thus, the external force and the reactive force can be reduced and removed.

Figure 5:
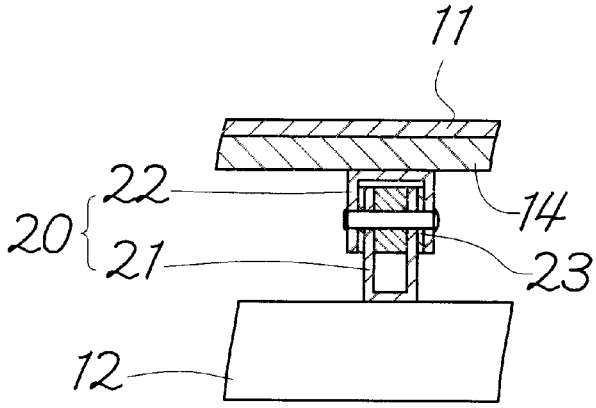
FIG. 5 is a side view of another embodiment of the deformed support plate of FIG. 3 restores itself to original state.

As shown in FIG. 5, a connecting piece 23 is interposed between both members 21, 22 of the support element 20. Accordingly, said connecting piece 23 is used to reduce or remove the noise during treadmill's operation when the support element 20 rotates due to the curved movement of the support plate 14, thereby creating a noiseless treadmill.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A treadmill comprises:

a base frame connected with a handrail;

two rollers disposed at both ends of said base frame;

a support plate interposed between rollers and fixed on said base frame; and a walking belt disposed around said rollers and said support plate;

wherein the improvement is characterized by:

said base frame having a plurality of crossbars in the position of said support plate, said crossbars being provided with at least one buffer piece in the middle thereof which is in contact with the bottom face of said support plate;

a support element having a bottom member on said base frame and a top member fixed on the bottom of said support plate, both members being pivotably connected, thereby positioning said support plate indirectly on said base frame;

so that the injury of the feet is avoided and the service life of said support plate is prolonged.

2. A treadmill comprises:

a base frame connected with a handrail;

two rollers disposed at both ends of said base frame;

a support plate interposed between rollers and fixed on said base frame; and a walking belt disposed around said rollers and said support plate;

wherein the improvement is characterized by:

said base frame having a plurality of crossbars in the position of said support plate, said crossbars being provided with at least one buffer piece in the middle thereof which is in contact with the bottom face of said support plate;

a support element having a bottom member on said base frame and a top member fixed on the bottom of said support plate, both members being pivotably connected while a connecting piece is interposed between both members of said support element, thereby positioning said support plate indirectly on said base frame;

so that the injury of the feet is avoided, the service life of said support plate is prolonged and the noised is removed.

* * * * *